United States Patent [19]

Kendrick

[11] 4,185,667

[45] Jan. 29, 1980

[54] POSITIONING AND HOLDING MECHANISMS FOR FILLING YARNS IN A SHUTTLELESS LOOM

[75] Inventor: Edd H. Kendrick, Cleveland, Tenn.

[73] Assignee: Rossville Mills, Inc., Rossville, Ga.

[21] Appl. No.: 906,982

[22] Filed: May 17, 1978

[51] Int. Cl.[2] ..... D03D 47/40; D03D 49/70

[52] U.S. Cl. ..... 139/302; 139/430; 139/453

[58] Field of Search ..... 139/430, 450, 453, 194, 139/263, 266, 302, 303, 294; 26/7, 10.4; 66/145

[56] References Cited

U.S. PATENT DOCUMENTS

| | | | |
|---|---|---|---|
| 3,951,177 | 4/1976 | Santucci | 139/453 |

FOREIGN PATENT DOCUMENTS

| | | | |
|---|---|---|---|
| 1410749 | 10/1968 | Fed. Rep. of Germany | 139/302 |
| 2509664 | 9/1976 | Fed. Rep. of Germany | 139/453 |
| 106527 | 9/1924 | Switzerland | 139/302 |

*Primary Examiner*—Henry Jaudon

*Attorney, Agent, or Firm*—Bell, Seltzer, Park & Gibson

[57] ABSTRACT

In a shuttleless loom for weaving repeating patterned fabrics including rapier mechanisms for inserting picks of selected ones of a plurality of filling yarns, a filling yarn pattern control mechanism for selectively presenting desired filling yarns at predetermined intervals to the rapier mechanism, cutter mechanisms for cutting the selected filling yarn when received by the rapier mechanism, and selvage trimming mechanisms for trimming the loose filling yarns extending outwardly from the woven fabric; the improvement is provided of mechanisms for positioning and holding the loose cut and uncut ends of filling yarns for trimming by the selvage trimming mechanisms and for continuing to hold under tension the cut ends of those filling yarns for which a repeat pick has not yet been called for in the repeating pattern of the fabric after cutting thereof by the selvage trimming mechanisms and, thereby, eliminating the prior necessity and cost of weaving false selvages which performed such positioning and holding actions and which were cut off by the selvage trimming mechanisms as waste.

13 Claims, 6 Drawing Figures

POSITIONING AND HOLDING MECHANISMS FOR FILLING YARNS IN A SHUTTLELESS LOOM

This invention relates to means for positioning and holding loose filling yarns for trimming by selvage trimming mechanisms and, preferably, for holding under tension the cut ends of those filling yarns for which a repeat pick has not yet been called for in a shuttleless rapier loom for weaving repeating patterned fabrics and, thereby, eliminating the prior necessity and costs of weaving false selvages with such loom which performed such positioning and holding actions and which were cut off by selvage trimming mechanisms as waste.

BACKGROUND OF THE INVENTION

In weaving of repeating patterned fabrics in the textile industry, particularly those fabrics woven with heavier denier yarns for use as upholstery fabrics and the like, shuttleless looms have become increasingly popular. Shuttleless looms used for these fabrics normally include rapier means for inserting picks of selected ones of a plurality of filling yarns into the fabric, a filling yarn pattern control means for selectively presenting desired filling yarns at predetermined intervals at the feed-in side of the loom to the rapier means in accordance with the desired repeating pattern of the fabric, cutter means on the feed-in side of the loom for cutting the selected filling yarn when received by the rapier means so that the rapier means inserts a free end of the selected filling yarn, and selvage trimming means for trimming the loose filling yarns extending outwardly from the woven fabric as the fabric is fed forwardly in the loom. Such a loom of the rigid double-rapier type is manufactured and sold by Lindauer Dornier Gesellschaft GmbH of Lindau Bodensee, West Germany.

In this type of shuttleless loom, a false selvage is woven on each side of the fabric with a skip-dent area in which the warp yarns are omitted separating the normal selvage edges of the fabric and the false selvages on each side of the fabric. These false selvage portions hold the loose filling yarns extending outwardly from the normal selvage edges of the woven fabric in position for cutting thereof in the skip-dent area of the fabric by the selvage trimming means and holds the cut ends of those filling yarns on the feed-in side of the loom for which a repeat pattern has not yet been called for in the repeating pattern of the fabric after cutting thereof by the selvage trimming means so that these filling yarns are held under tension and do not back up through the filling yarn pattern control means. These false selvages, after being cut by the selvage trimming means and after performing the above functions, were discarded as waste.

Manifestly, the excess length of filling yarns along with the extra ends of warp yarns required for weaving such false selvages increased the cost of the woven fabric and limited the effective width for which the resulting fabric could be woven on a particular loom.

OBJECTS AND SUMMARY OF THE INVENTION

Accordingly, it is the object of this invention to provide means for positioning and holding loose cut and uncut ends of filling yarns for trimming by selvage trimming mechanisms and, preferably, for continuing to hold under tension the cut ends of those filling yarns for which a repeat pick has not yet been called for in a shuttleless rapier loom for weaving repeating patterned fabrics after cutting and, thereby, eliminating the prior necessity and cost of weaving false selvages with such looms which perform such positioning and holding action and which were cut off by selvage trimming mechanisms as waste.

In accordance with this invention, such positioning and holding means are provided, in a shuttleless loom, preferably, for weaving repeating patterned fabrics, including rapier means for inserting picks of selected ones of a plurality of filling yarns into the fabric, a filling yarn pattern control means for selectively presenting desired filling yarns at predetermined intervals at the feed-in side of the loom to the rapier means in accordance with the pattern of the fabric, cutter means on the feed-in side of the loom for cutting the selected filling yarn when received by the rapier means so that the rapier means inserts a free end of the selected filling yarn, and selvage trimming means for trimming the loose filling yarns extending outwardly from the woven fabric as the fabric is fed forwardly in the loom, as follows.

Means are positioned between the beat-up point of the fabric and the selvage trimming means for gripping and positioning generally outwardly the cut and uncut ends of the filling yarns extending from the selvage edges of the woven fabric after having been inserted therein by the rapier means. Vacuum holding and removal means are positioned subsequent to the gripping and positioning means and adjacent the selvage trimming means (1) for receiving from the gripping and positioning means the outwardly positioned cut and uncut ends of the filling yarns extending from the woven fabric, (2) for holding such filling yarns during cutting by the selvage trimming means, (3) preferably for cooperating with the gripping and positioning means for continuing to hold under tension the cut ends of those filling yarns for which a repeat pattern has not yet been called for and (4) for removing loose portions of the filling yarns after being completely cut off.

Preferably, the gripping and positioning means comprises a wheel member mounted adjacent and above the selvage edge of the fabric for free rotation in the direction of travel of the fabric in the loom, and a driven shaft mounted under the fabric and extending transversely thereof and being rotated in the direction of travel of the fabric through the loom and forming a generally loose nip with the wheel member. By this arrangement, the cut and uncut portions of the filling yarns extending from the woven fabric will be received in the nip formed between the wheel member and the shaft during forward travel of the fabric through the loom and will be gripped therebetween and positioned generally outwardly during rotation of the wheel member and the shaft for reception and holding by the vacuum means.

Preferably, the vacuum holding and removal means includes a nozzle portion having an open front for reception of the cut and uncut portions of the filling yarns from the gripping and positioning means and an open side facing the fabric extending from the open front along the nozzle portion to a location adjacent the selvage trimming means for holding the filling yarns during cutting by the selvage trimming means.

The above described improvements of this invention are particularly applicable to a shuttleless rapier loom for weaving repeating patterned fabrics in which some of the filling yarns are not repeated in the pattern until after the selvage trimming means have cut such filling yarns on the feed-in side; however, the improvements are also applicable to the same type of loom used for weaving substantially non-repeating patterned fabrics. Also, while the gripping and positioning wheel member provides advantages on the non-feed-in side of the loom, it is not essential on that side of the loom.

The improvement of this invention further includes an improved construction of the selvage trimming means which preferably comprises a scissors-type cutter including two cutter blades movably connected with each other at the rear ends thereof for forming when opened a sideways V-shaped opening which is closed at the apex for receipt therein of the filling yarns to be cut and for closing to cut the filling yarns, and means connected with the cutter for opening and closing the cutter at desired intervals for trimming the filling yarn as the woven fabric travels through the loom.

Prior Art

Although various mechanisms have heretofore been suggested for trimming loose filling yarns extending from the selvage edges of woven fabrics, some of which utilize vacuum holding means, none of these prior mechanisms have been suggested for the combined functions of the mechanisms of the present invention (1) for positioning and holding loose filling yarns extending from the selvage edges of the fabric for trimming by selvage trimming means and (2) for holding under tension the cut ends of those filling yarns on the feed-in side of the loom for which a repeat pick has not yet been called for in the repeating pattern of the fabric after cutting thereof by the selvage trimming means, which eliminates the prior necessity and cost of weaving false selvages which performed such positioning and holding actions and which were cut off by the selvage trimming means as waste.

Examples of such prior mechanisms considered with respect to the present invention, are as follows:

| Patent Number | Inventor | Issue Date |
|---|---|---|
| U.S. 1,576,476 | F. C. Whittier | March 9, 1926 |
| U.S. 2,080,784 | W. Pool | May 18, 1937 |
| U.S. 2,099,461 | E. Bernstein | November 16, 1937 |
| U.S. 2,584,620 | J. Rubin | February 5, 1952 |
| U.S. 2,962,791 | L. Remington | December 6, 1960 |
| U.S. 3,105,284 | H. A. Krug | October 1, 1963 |
| U.S. 3,225,794 | Y. Juillard | December 28, 1965 |
| U.S. 3,258,038 | V.M.J. Ancet et al | June 28, 1966 |
| U.S. 3,299,912 | J. Birmans et al | January 24, 1967 |
| U.S. 3,347,282 | N. Kokkinis | October 17, 1967 |
| U.S. 3,376,903 | R. B. Golobart | April 9, 1968 |
| U.S. 3,455,342 | R. B. Golobart | July 15, 1969 |
| U.S. 3,460,212 | N. Elsas et al | August 12, 1969 |
| U.S. 3,580,293 | T. Fransen | May 25, 1971 |
| German 1,220,377 | | July 7, 1966 |

DESCRIPTION OF PREFERRED EMBODIMENT

Figure 1:
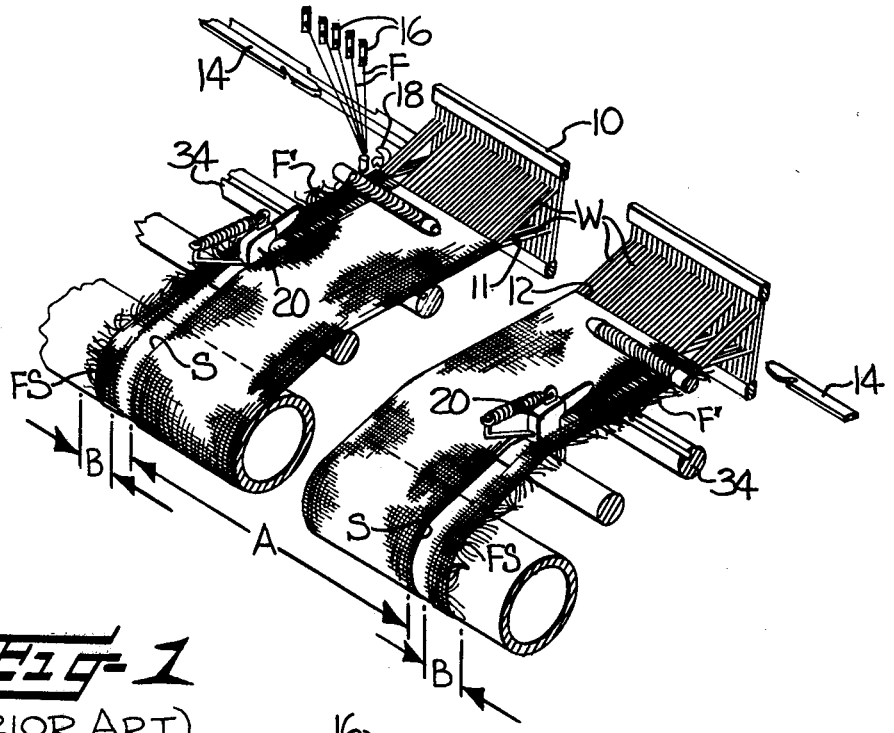
Fig-1 (PRIOR ART)
FIG. 1 is a schematic perspective view of certain portions of a rigid double-rapier shuttleless loom constructed in accordance with prior practices and labeled "Prior Art;"

Referring now to the drawings, there is illustrated therein pertinent portions only of a rigid double-rapier shuttleless loom, particularly adapted for weaving of upholstery and other types of fabrics having repeating patterns formed by selective insertion at desired intervals of picks of selected ones of a plurality of filling yarns, some of which filling yarns are only utilized in the repeating patterns after substantial nonuse thereof. These looms may also be utilized for weaving substantially non-repeating patterns and the improvements of this invention will be applicable thereto. Such rigid double-rapier shuttleless looms are well known to those with ordinary skill in the textile art and a full illustration and description of such looms is not believed necessary and will not be given herein for an understanding of the improved mechanisms of the present invention.

Figure 2:
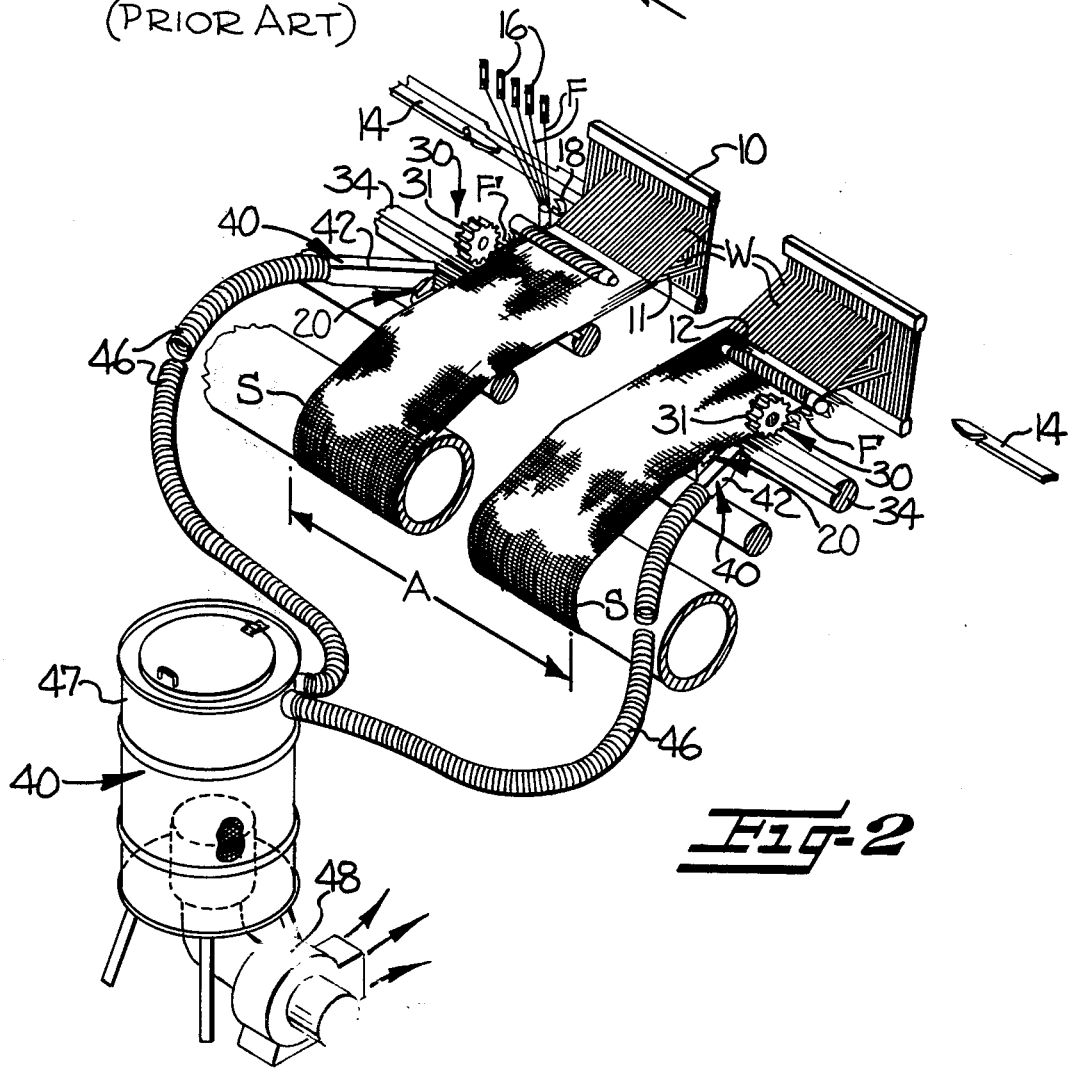
FIG. 2 is a schematic perspective view, like FIG. 1, of portions of a rigid double-rapier shuttleless loom utilizing the improved mechanisms of this invention.
Figure 3:
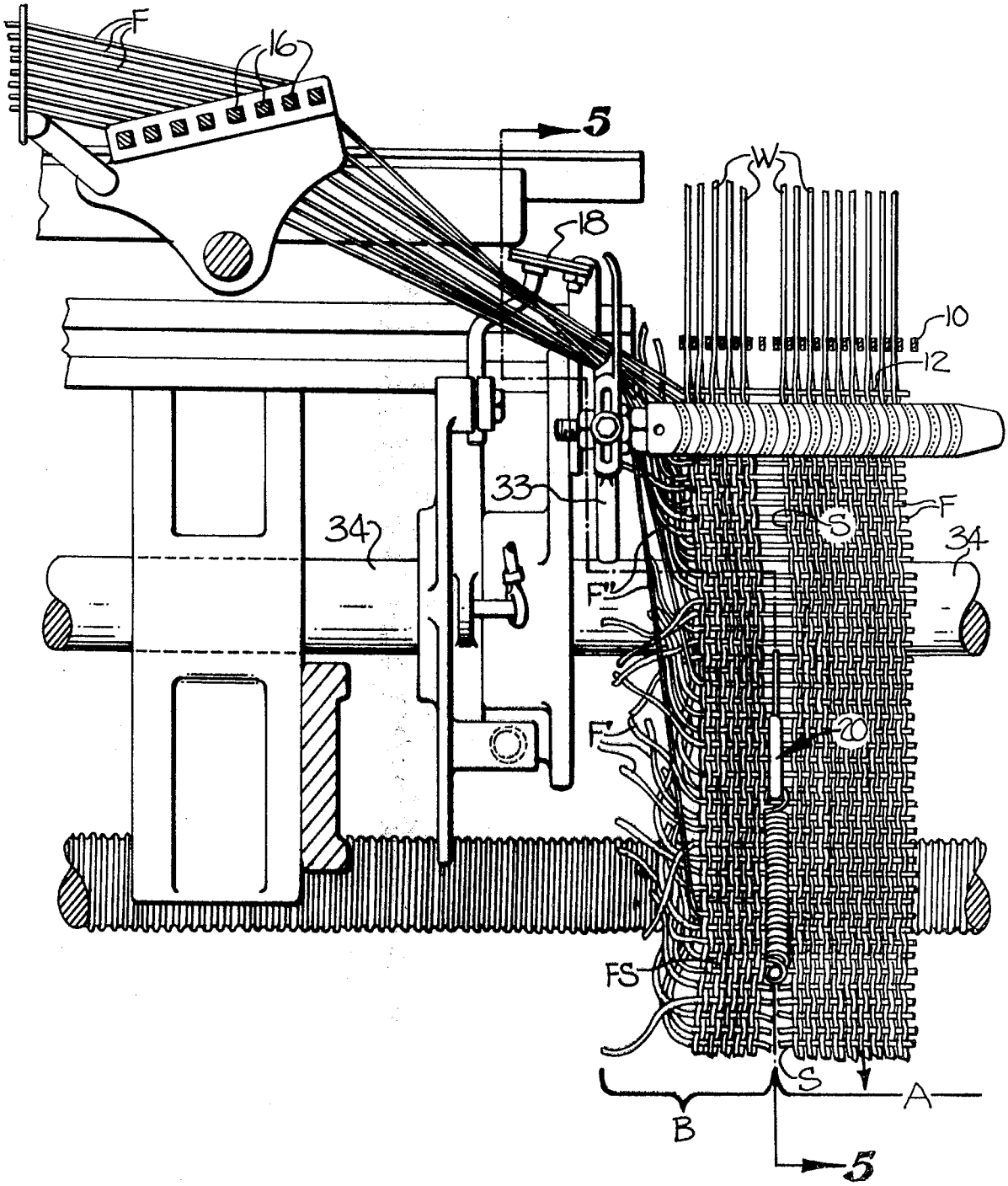
FIG. 3 (PRIOR ART)
FIG. 3 is a partial top plan view taken on the feed-in side of a rigid double-rapier loom constructed in accordance with prior practices and labeled "Prior Art;"
Figure 4:
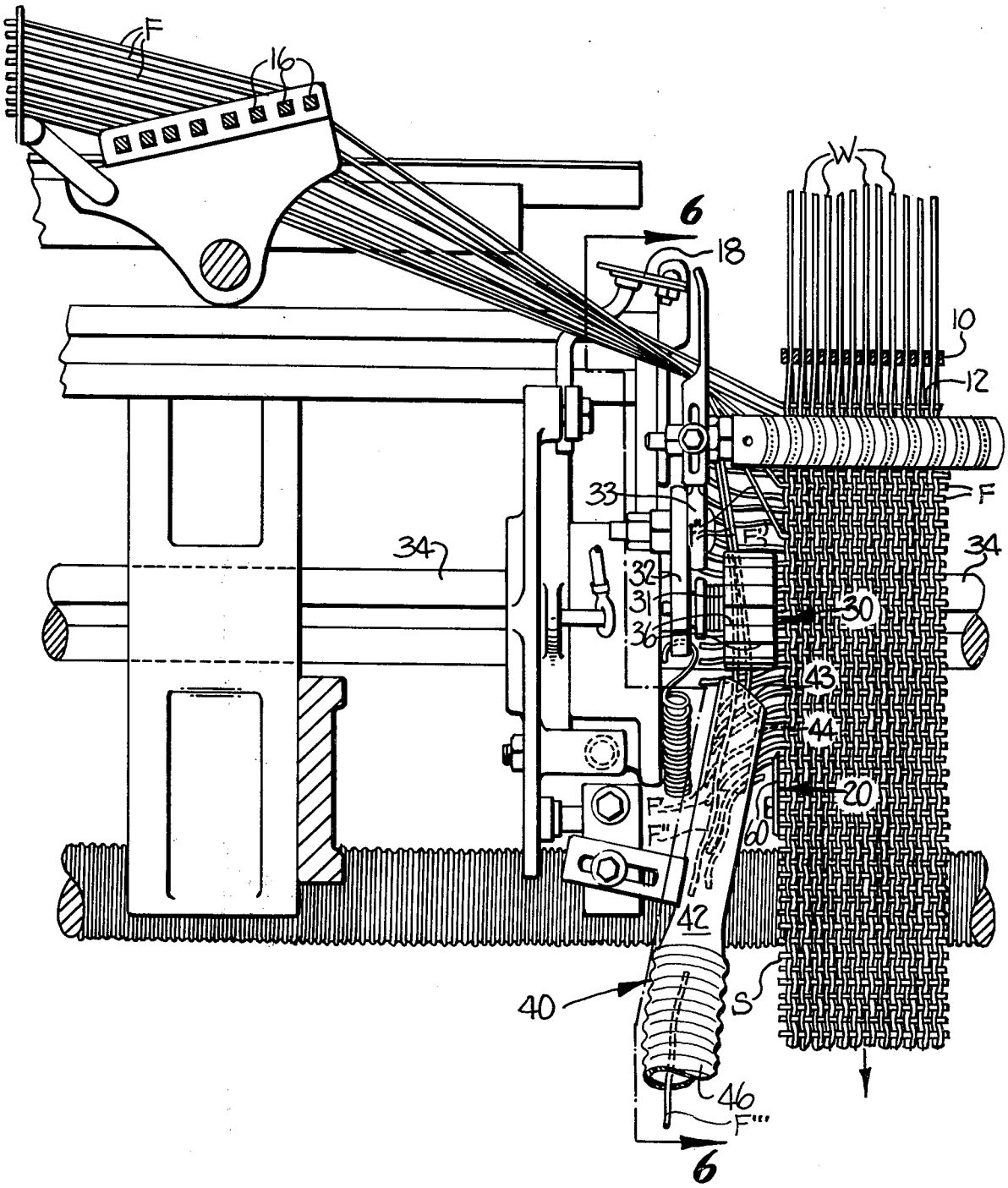
FIG. 4 is a partial top plan view, like FIG. 3, taken on the feed-in side of a rigid double-rapier loom illustrating the use of the mechanisms of the present invention.
Figure 5:
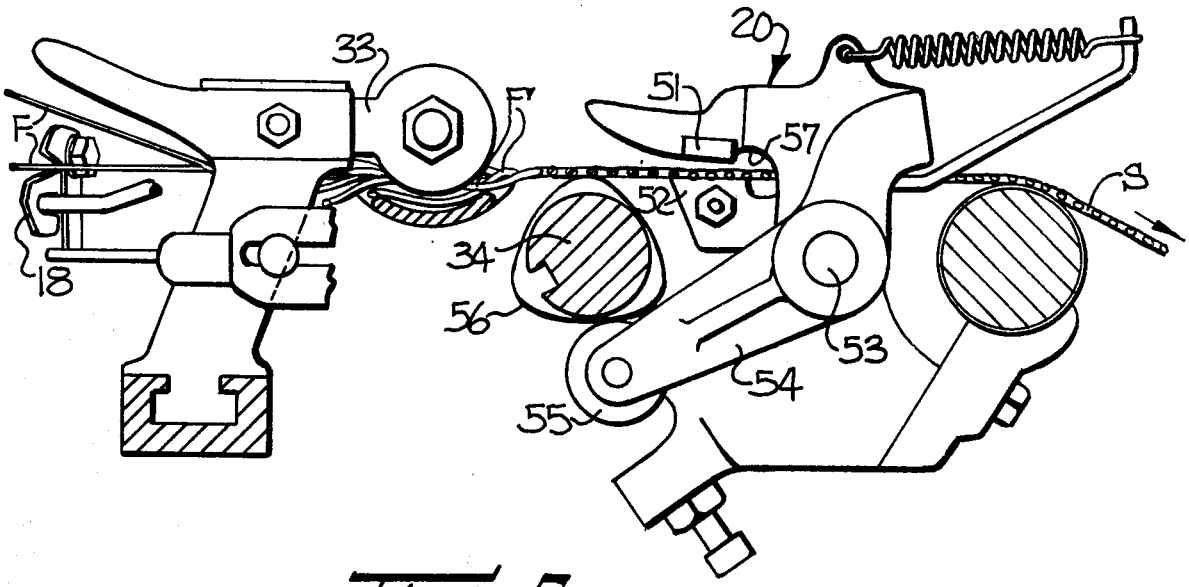
Fig-5 (PRIOR ART)
FIG. 5 is a sectional view, taken generally along the line 5—5 of FIG. 3 illustrating previously utilized mechanisms and labeled "Prior Art.
Figure 6:
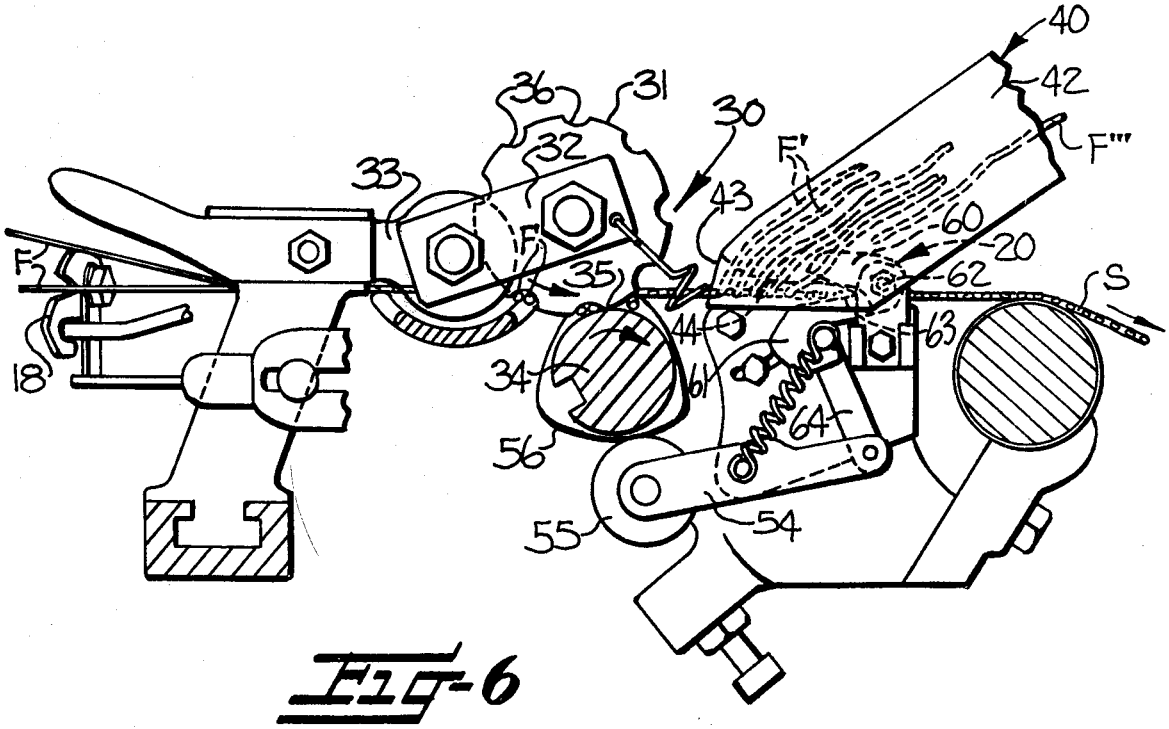
" and FIG. 6 is a sectional view, like FIG. 5, taken generally along the line 6—6 of FIG. 4, illustrating the use of the mechanisms of this invention.

However, inasmuch as the mechanisms of the present invention perform the functions of and eliminate the prior necessity and cost of weaving false selvages on each side of the woven fabric as it is woven in such rigid double-rapier shuttleless looms, both the prior construction of such looms in which false selvages were woven on each side of the fabric has been illustrated in FIGS. 1, 3 and 5 and labeled "Prior Art" and the present construction of such looms with the improved mechanisms of this invention has been illustrated in FIGS. 2, 4 and 6 for ready comparison and an easy understanding of the present invention.

Both the prior and present constructions of rigid double-rapier shuttleless looms, as illustrated in the drawings, include a plurality of warp yarns W extending from a warp beam (not shown) to a reed mechanism 10 mounted on the lay of the loom and receiving the warp yarns W therebetween which are separated into a shed 11 or opening for receipt of filling yarns F during weaving to be beaten up by the reed 10 as it is reciprocated forwardly to the beat-up point 12 of the fabric. The filling yarns F are inserted through the shed 11 by double rapiers 14 in which the rapier 14 on the feed-in side (left side as viewed in the drawings) receives a selected filling yarn F extending from a supply creel (not shown) through a pattern control mechanism 16 and inserts the selected filling yarn F through the shed 11 between warp yarns W to generally the center of the loom where the other rapier 14 receives the filling yarn F and completes the insertion of the filling yarn F through the shed 11 between warp yarns W in a well known manner.

The filling yarn pattern control mechanism 16 separately receives each of a plurality of the filling yarns F from the supply creel and selectively presents the desired filling yarn F at predetermined intervals on the feed-in side of the loom to the rapier 14 in accordance with the repeating pattern of the fabric in a well known manner. A cutter device 18 is mounted on the feed-in side of the loom for cutting the selected filling yarn F when received by the rapier 14 so that the rapier 14 inserts a cut free end of the selected filling yarn F through the shed 11 between the warp yarns W.

After the thus inserted filling yarns F have been beaten up by the reed 10 to the beat-up point 12 of the woven fabric, loose cut ends F′ of filling yarns F will extend from the selvage edge S of the fabric on the nonfeed-in side (right side as viewed in the drawings) and loose cut ends F′ of filling yarns F will be present on the feed-in side (left side as viewed in the drawings) after the cutter mechanism 18 has cut the particular filling yarn F during its next insertion into the fabric by the rapier means 14. However, those ends F″ of filling yarns F which have been inserted into the woven fabric, but have not yet been called for in the repeating pattern of the fabric, will not be cut on the feed-in side of the loom, but will extend from the selvage edge S of the woven fabric back through the pattern control mechanism 16 to the supply creel, as shown in FIGS. 3 and 4.

There is further provided selvage trimming mechanisms 20 for trimming or cutting the ends F′ and F″ of the loose filling yarns F extending outwardly from each selvage edge S of the woven fabric as the fabric is fed forwardly in the loom. These selvage trimming mechanisms 20 will cut off the loose cut ends F′ of filling yarns on the nonfeed-in side of the loom so as to present a smooth selvage edge. Also, the selvage trimming mechanisms 20 on the feed-in side of the loom will trim both the cut ends F′ of filling yarns F for which a repeat pick of such filling yarns has already been called for, along with the uncut ends F″ of filling yarns F extending outwardly from the woven fabric back through the filling yarn pattern control mechanism 16.

In order for the ends F′ and F″ of filling yarns F on each side of the fabric to be properly cut by the selvage trimming mechanisms 20, they must be held in a generally outwardly extending position generally transversely of the fabric. Due to the normal forces of gravity and movement of the fabric through the loom, these cut ends F′ of filling yarns F tend to position themselves longitudinally of the fabric, rather than transversely outwardly. This is further enhanced on the feed-in side of the loom by the action of the uncut end F″ of filling yarns F for which a repeat pattern has not yet been called for, acting to push the cut ends F′ of filling yarns F back toward the selvage edge S of the fabric. Also, some means must be provided for holding the cut ends F″ of filling yarns F, for which a repeat pattern has not yet been called for, after cutting thereof by the selvage trimming mechanisms 20. Otherwise, these filling yarns F would not be held under tension and would tend to back up through the filling yarn pattern control mechanism 16 to the supply creel and trigger stop motion mechanisms (not shown) in the loom which would stop operation of the loom.

Heretofore, these positioning and holding functions were performed, as illustrated in FIGS. 1 and 3, by weaving false selvages FS on each side of the normal selvage edges S of the woven fabric with a skip-dent area between the false selvages FS and the normal selvages S of the woven fabric. Such skip-dent areas are formed by omitting warp yarns in those areas. As may be clearly seen in FIGS. 1 and 3, the cut and uncut ends F′ and F″ of the filling yarns F extending outwardly from the normal selvage edges S of the fabric will be held in proper position by the false selvages FS for cutting by the selvage trimming mechanisms 20. Additionally, the false selvages FS will continue to hold under tension those filling yarns F for which a repeat pattern has not yet been called for in the repeating pattern of the fabric after cutting thereof by the selvage trimming mechanisms 20. However, as shown in FIG. 1, substantial areas indicated by the portions B of the filling yarns F, along with the warp yarns W utilized, are wasted by weaving of such false selvages FS. Additionally, the effective woven width of the fabric, indicated by the portion A, which can be woven on such a loom is reduced by the areas B occupied by the false selvages FS.

The above-described weaving operations and construction of rigid double-rapier looms are well known to those with ordinary skill in the textile art and further explanation and illustration of such looms and their operation are not believed necessary for an understanding of the present invention.

In accordance with the present invention, mechanisms are provided, as illustrated in FIGS. 2, 4 and 6, for positioning and holding the loose ends F′ and F″ of filling yarns F for trimming by the selvage trimming mechanisms 20 and for continuing to hold under tension the ends F″ of those filling yarns F on the feed-in side of the loom for which a repeat pick has not yet been called for in the repeating pattern of the fabric after cutting thereof by the selvage trimming mechanisms 20 and, thereby, eliminating the prior necessity and cost of weaving false selvages FS which performed such positioning and holding actions and which were cut off by the selvage trimming mechanisms 20 as waste.

These positioning and holding mechanisms of the present invention comprise means, generally indicated at 30, positioned between the beat-up point 12 of the fabric and the selvage trimming mechanisms 20 and carried by the loom for gripping and positioning generally outwardly the cut and uncut ends F′ and F″ of the filling yarns F extending from the selvage edges S of the woven fabric after having been inserted therein by the rapier means 14. This gripping and positioning means comprises at least one and preferably two wheel members 31 respectively mounted adjacent and above each of the two longitudinal selvage edges S of the fabric on each side thereof for free rotation in the direction of travel of the fabric in the loom. These wheel members 31 may be mounted by any suitable means such as arm 32, as shown in FIG. 6, extending from any suitable frame or other portion 33 of the loom. The gripping and positioning means 30 further includes a driven shaft 34 forming a previously existing part of the loom and mounted under the fabric and extending transversely thereof beyond each of the selvage edges and being rotated in the direction of travel of the fabric through the loom and forming a generally loose nip 35 with each of the wheel members 31 as may be seen in FIG. 6.

The wheel members 31 preferably include outer generally flat surfaces having grooves 36 therein of generally semicircular cross-sectional configuration extending in the direction of the filling yarn, as may be seen in FIG. 6. This shape aids in the gripping and positioning action of these wheel members 31.

With the above arrangement of the gripping and positioning means 30, the cut and uncut end F′ and F″ of the fill yarns F extending outwardly from the woven fabric on the feed-in side of the loom and the cut ends F′ of the filling yarns F extending from the woven fabric on the other or nonfeed-in side of the loom will be received in the respective nips 35 formed between the respective wheel members 31 and the shaft 34 during forward travel of the fabric through the loom and will be gripped therebetween and positioned generally outwardly during rotation of the wheel members 31 and the shaft 34, as shown in FIG. 4. This outward gripping and positioning of the ends F' and F'' of filling yarns F on the feed-in side of the loom by the gripping and positioning means 30 of this invention is clearly shown when comparing the position of these cut and uncut ends F' and F'' of filling yarns F on the feed-in side of the loom in FIG. 4 as contrasted with the position these cut and uncut ends F' and F'' of filling yarns F would occupy in the absence of the gripping and positioning means 30 as shown in FIG. 3.

The positioning and holding mechanisms of the present invention further include vacuum holding and removal means, generally indicated at 40, which are positioned subsequent to the gripping and positioning means 30 in the direction of travel of the fabric through the loom and adjacent the respective selvage trimming mechanisms 20. The vacuum holding and removal means 40 receives, from the gripping and positioning means 30, the outwardly positioned cut and uncut ends F' and F'' of the filling yarns F extending from the respective selvage edges S of the woven fabric and holds such filling yarns F during cutting by the selvage trimming mechanisms 20. The vacuum holding and removal means 40 further cooperate with the gripping and positioning means 30, as shown in FIG. 4, for continuing to hold under tension the ends F'' of those filling yarns for which a repeat pattern has not yet been called for after cutting by the selvage trimming mechanisms 20. The vacuum holding and removal means 40 further removes loose portions F''' of the filling yarns F after being completely cut off, as shown in FIG. 4.

This vacuum holding and removal means includes a nozzle portion 42 having an open front 43 for reception of the cut and uncut ends F' and F'' of filling yarns F on the feed-in side of the loom and the cut portions F' of the filling yarns F on the other side of the loom from the respective gripping and positioning means 30. The nozzle portions 42 each further include an open side 44 facing the fabric and extending from the open front 43 along the nozzle portion 42 to a location generally adjacent the respective selvage trimming mechanisms 20 for holding the ends F' and F'' of filling yarns F during cutting by the respective selvage trimming mechanisms 20, as shown in FIG. 4.

The vacuum holding and removal means 40 further includes separate conduits 46 leading at one end from each of the nozzle portions 42 and connecting at the other end with a common waste receptacle 47 which receives cut off portions F''' of the filling yarns F and includes a top portion thereon which may be opened for removal of the waste yarns therefrom. A suitable fan mechanism 48 is connected with the waste receptacle 47, as shown in FIG. 2, for creating a negative air flow through the receptacle 47, the conduits 46 and the nozzle portions 42.

The improvements of this invention further include an improved construction of the selvage trimming mechanisms 20 over that which was originally utilized in the rigid double-rapier shuttleless loom. As shown particularly in FIG. 5, the prior selvage cutter mechanisms 20 included a pair of blade members 51, 52 in which the blade member 51 was movably mounted on pivot 53 and was operatively connected with lever arm 54 which carried a cam follower 55 on its outer end for contact with the outer surface of a cam 56 mounted on the shaft 34. As the follower 55 moves around the profile of the cam 56 during driving rotation of the shaft 34, the blade member 51 would be moved into and out of cutting engagement with the blade 52 for trimming the selvage edges.

However, problems were caused by the configuration of the blades 51, 52 inasmuch as these blades included an opening 57 in the rear portions thereof which tended to accumulate filling yarns F therein during the intervals between cutting actions of the blades 51, 52 and resulted in these filling yarns not being cut by the prior selvage trimming mechanisms 20.

In accordance with the present invention, an improved scissors-type cutter is provided, as shown in FIG. 6, including two cutter blades 60, 61 movably connected with each other at the rear ends thereof or pivot point 62 for forming when opened a sideways V-shaped opening 63 which is closed at the apex thereof for receipt therein of the filling yarns F to be cut and for closing under the action of a lever 64 connected with the lever 54 moving under the influence of cam follower 55 in engagement with driven cam 56. Inasmuch as the cutter blades 60, 61 have a V-shaped opening 63 closed at the apex thereof, the problems of accumulation of filling yarns F in a space at the rear of such cutter blades, as occurred with the prior selvage trimming mechanism illustrated in FIG. 5, are overcome by the improved selvage trimming mechanism, illustrated in FIG. 6, utilized in the present invention.

Accordingly, this invention has provided means for positioning and holding the loose cut and uncut ends F' and F'' of filling yarns F for trimming by the selvage trimming mechanisms 20 and for continuing to hold under tension the ends F'' of those filling yarns F on the feed-in side of the loom for which a repeat pick has not yet been called for in the repeating pattern of the fabric after cutting thereof by the selvage trimming mechanisms 20 and, thereby, eliminating the prior necessity and cost of weaving false selvages FS which perform such positioning and holding actions and which were cut off by the selvage trimming mechanisms 20 as waste. Additionally, this invention has provided the additional improvement of an improved selvage trimming cutter mechanism which eliminates problems presented with the prior selvage trimming mechanism.

The savings effected by the mechanisms of the present invention are evident from the above description. It is estimated that three-quarters of an inch of filling yarns on each side or one and one-half inches of filling yarn for each pick are saved with the mechanisms of this invention. This effectively reduces by twenty-five percent the amount of filling yarns which will be cut off as waste when weaving the fabric of this invention. Additionally, eight ends of warp yarn are utilized in each false selvage which would save a total of sixteen ends of warp yarn when utilizing the mechanisms of this invention.

In the drawings and specification, there has been set forth a preferred embodiment of the invention and, although specific terms are employed, they are used in a generic and descriptive sense only and not for purposes of limitation.

What is claimed is:

1. In a shuttleless loom, preferably for weaving repeating patterned fabrics, including rapier means for inserting picks of selected ones of a plurality of filling yarns into the fabric, a filling yarn pattern control means for selectively presenting desired filling yarns at predetermined intervals at the feed-in side of said loom to said rapier means in accordance with the pattern of the fabric, cutter means on the feed-in side of said loom for cutting the selected filling yarn when received by said rapier means so that said rapier means inserts a free end of the selected filling yarn, and selvage trimming means positioned downstream of the beat-up point of the fabric for trimming the loose ends of filling yarns extending outwardly from the woven fabric as the fabric is fed forwardly in said loom; the improvement of means for positioning and holding the loose cut and uncut ends of filling yarns for trimming by said selvage trimming means and, preferably, for continuing to hold under tension the ends of those filling yarns on the feed-in side of said loom for which a repeat pick has not yet been called for in the repeating pattern of the fabric after cutting thereof by said selvage trimming means, said positioning and holding means comprising means positioned between the beat-up point of the fabric and said selvage trimming means for gripping and positioning generally outwardly the cut and uncut ends of the filling yarns extending from the woven fabric after having been inserted therein by said rapier means, and vacuum holding and removal means positioned subsequent to said gripping and positioning means and adjacent said selvage trimming means for receiving from said gripping and positioning means the outwardly positioned cut and uncut ends of the filling yarns extending from the woven fabric, for holding such filling yarns during cutting by said selvage trimming means, for preferably cooperating with said gripping and positioning means for continuing to hold under tension the cut ends of those filling yarns for which a repeat pick has not yet been called for after cutting thereof by said selvage trimming means, and for removing loose portions of the filling yarns after being completely cut off.

2. In a shuttleless loom, as set forth in claim 1, in which said gripping and positioning means comprises a wheel member mounted adjacent and above the selvage of the fabric for free rotation in the direction of travel of the fabric in said loom, and a driven shaft mounted under the fabric and extending transversely thereof and being rotated in the direction of travel of the fabric through said loom and forming a generally loose nip with said wheel member, whereby, the cut and uncut ends of the filling yarns extending from the woven fabric will be received in the nip formed between said wheel member and said shaft during forward travel of the fabric through said loom and will be gripped therebetween and positioned generally outwardly during rotation of said wheel member and said shaft for reception and holding by said vacuum means.

3. In a shuttleless loom, as set forth in claim 2, in which said wheel member includes an outer generally flat surface having grooves therein of generally semicircular cross-sectional configuration extending in the direction of the filling yarns.

4. In a shuttleless loom, as set forth in claim 1, in which said vacuum holding and removal means includes a nozzle portion having an open front for reception of cut and uncut portions of the filling yarns from said gripping and positioning means and an open side facing the fabric extending from said open front along said nozzle portion to a location adjacent said selvage trimming means for holding the filling yarns during cutting by said selvage trimming means.

5. In a shuttleless loom, as set forth in claim 4, in which said vacuum means further includes a conduit leading at one end from said nozzle portion, a waste yarn receptacle connected to the other end of said conduit for receiving cut off portions of filling yarns, and fan means connected with said waste yarn receptacle for creating a negative air flow through said receptacle, said conduit and said nozzle portion.

6. In a shuttleless loom, as set forth in claim 1, in which the improvement further includes an improved construction of said selvage trimming means comprising a scissors-type cutter including two cutter blades movably connected with each other at the rear ends thereof for forming when opened a sideways V-shaped opening which is closed at the apex for receipt therein of the filling yarns to be cut and for closing to cut the filling yarns, and means connected with said cutter for opening and closing said cutter at desired intervals for trimming the filling yarn as the woven fabric travels through said loom.

7. In a shuttleless loom, preferably for weaving repeating patterned fabrics, including rapier means for inserting picks of selected ones of a plurality of filling yarns into the fabric, a filling yarn pattern control means for selectively presenting desired filling yarns at predetermined intervals at the feed-in side of said loom to said rapier means in accordance with the pattern of the fabric, cutter means on the feed-in side of said loom for cutting the selected filling yarn when received by said rapier means so that said rapier means inserts a free end of the selected filling yarn, and selvage trimming means positioned downstream of the beat-up point of the fabric for trimming the loose ends of filling yarns extending outwardly from the woven fabric as the fabric is fed forwardly in said loom; the improvement of means for positioning and holding the loose cut and uncut ends of filling yarns for trimming by said selvage trimming means and, preferably, for continuing to hold under tension the ends of those filling yarns on the feed-in side of said loom for which a repeat pick has not yet been called for in the repeating pattern of the fabric after cutting thereof by said selvage trimming means, said positioning and holding means comprising means positioned between the beat-up point of the fabric and said selvage trimming means, comprising a wheel member mounted adjacent and above the selvage of the fabric for free rotation in the direction of travel of the fabric in said loom and a driven shaft mounted under the fabric and extending transversely thereof and being rotated in the direction of travel of the fabric through said loom and forming a generally loose nip with said wheel member, for receiving the cut and uncut ends of the filling yarns extending from the woven fabric after having been inserted therein by said rapier means in the nip formed between said wheel member and said shaft during forward travel of the fabric through said loom and for gripping and positioning generally outwardly such ends of the filling yarns during rotation of said wheel member and said shaft, and vacuum holding and removal means positioned subsequent to said wheel member and shaft and adjacent said selvage trimming means and including a nozzle portion having an open front for receiving from said wheel member and shaft the outwardly positioned cut and uncut ends of the filling yarns extending from the woven fabric and an open side facing the fabric and extending from said open front along said nozzle portion to a location adjacent said selvage trimming means for holding the ends of the filling yarns during cutting by said selvage trimming means, said vacuum means and said wheel member and shaft preferably cooperating for continuing to hold under tension the ends of those filling yarns for which a repeat pick has not yet been called for after cutting thereof by said selvage trimming means, and said vacuum means further operating for removing loose portions of the filling yarns after being completely cut off.

8. In a shuttleless loom for weaving repeating patterned fabrics including a rigid double-rapier means for inserting picks of selected ones of a plurality of filling yarns into the fabric, a filling yarn pattern control means for selectively presenting desired filling yarns at predetermined intervals at the feed-in side of said loom to said rapier means in accordance with the repeating pattern of the fabric, cutter means on the feed-in side of said loom for cutting the selected filling yarn when received by said rapier means so that said rapier means inserts a free end of the selected filling yarn, and selvage trimming means positioned on each side of the woven fabric downstream of the beat-up point for trimming the loose ends of filling yarns extending outwardly from each side of the woven fabric as the fabric is fed forwardly in said loom; the improvement of means on each side of the fabric for positioning and holding the loose cut and uncut ends of filling yarns for trimming by said selvage trimming means and for continuing to hold under tension the ends of those filling yarns on the feed-in side of said loom for which a repeat pick has not yet been called for in the repeating pattern of the fabric after cutting thereof by said selvage trimming means, each of said positioning and holding means on each side of the fabric comprising means positioned between the beat-up point of the fabric and said selvage trimming means for gripping and positioning generally outwardly the cut and uncut ends of the filling yarn extending from the woven fabric on the feed-in side of said loom and the cut ends of the filling yarns extending from the woven fabric on the other side of said loom, and vacuum holding and removal means positioned subsequent to said gripping and positioning means and adjacent said selvage trimming means for receiving from said gripping and positioning means the outwardly positioned cut and uncut ends of the filling yarns extending from the woven fabric on the feed-in side of said loom and the cut ends of the filling yarns extending from the woven fabric on the other side of said loom, for holding such ends of filling yarns during cutting by said selvage trimming means, for cooperating with said gripping and positioning means for continuing to hold under tension the ends of those filling yarns on the feed-in side of said loom for which a repeat pick has not yet been called for after cutting thereof by said selvage trimming means and for removing loose portions of the filling yarns after being completely cut off.

9. In a shuttleless loom, as set forth in claim 8, in which said gripping and positioning means comprise two wheel members respectively mounted adjacent and above each of the two longitudinal selvages of the fabric on each side thereof for free rotation in the direction of travel of the fabric in said loom, and a driven shaft mounted under the fabric and extending transversely thereof beyond each of the selvages and being rotated in the direction of travel of the fabric through said loom and forming a generally loose nip with each of said wheel members, whereby, the cut and uncut ends of the filling yarn extending from the woven fabric on the feed-in side of said loom and the cut ends of the filling yarns extending from the woven fabric on the other side of said loom will be received in the respective nips formed between said respective wheel members and said shaft during forward travel of the fabric through said loom and will be gripped therebetween and positioned generally outwardly during rotation of said wheel members and said shaft for reception and holding by said respective vacuum means.

10. In a shuttleless loom, as set forth in claim 9, in which each of said wheel members include an outer generally flat surface having grooves therein of generally semicircular cross-sectional configuration extending in the direction of the filling yarns.

11. In a shuttleless loom, as set forth in claim 8, in which each of said vacuum means includes a nozzle portion having an open front for respective reception of cut and uncut ends of filling yarns on the feed-in side of said loom and cut ends of filling yarns on the other side of said loom from said respective gripping and positioning means and an open side facing the fabric and extending from said open front along said nozzle portion to a location adjacent said respective selvage trimming means for holding the ends of filling yarns during cutting by said respective selvage trimming means.

12. In a shuttleless loom, as set forth in claim 11, in which said vacuum means further include separate conduits leading at one end from each of said nozzle portions, a common waste yarn receptacle connected to the other ends of said conduits for receiving cut off portions of filling yarns, and fan means connected with said waste yarn receptacle for creating a negative air flow through said receptacle, said conduits and said nozzle portions.

13. In a shuttleless loom, as set forth in claim 8, in which the improvement further includes an improved construction of said selvage trimming means comprising a scissors-type cutter including two cutter blades movably connected with each other at the rear ends thereof for forming when opened a sideways V-shaped opening which is closed at the apex for receipt therein of the filling yarns to be cut and for closing to cut the filling yarns, and means connected with said cutter for opening and closing said cutter at desired intervals for trimming the filling yarn as the woven fabric travels through said loom.

* * * * *